US009472135B2

(12) United States Patent
Wen et al.

(10) Patent No.: US 9,472,135 B2
(45) Date of Patent: Oct. 18, 2016

(54) AMOLED (ACTIVE MATRIX ORGANIC LIGHT EMITTING DIODE) PANEL DRIVING CIRCUIT AND DRIVING METHOD

(71) Applicant: Shenzhen China Star Optoelectronics Technology Co., Ltd., Shenzhen, Guangdong (CN)

(72) Inventors: Yichien Wen, Guangdong (CN); Chunhuai Li, Guangdong (CN); Liwei Chu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 433 days.

(21) Appl. No.: 14/241,068

(22) PCT Filed: Dec. 31, 2013

(86) PCT No.: PCT/CN2013/091235
§ 371 (c)(1),
(2) Date: Feb. 25, 2014

(87) PCT Pub. No.: WO2015/078087
PCT Pub. Date: Jun. 4, 2015

(65) Prior Publication Data

US 2016/0005355 A1 Jan. 7, 2016

(30) Foreign Application Priority Data

Nov. 29, 2013 (CN) ..... 2013 1 0632727

(51) Int. Cl.
*G09G 3/32* (2016.01)
*G09G 3/20* (2006.01)

(52) U.S. Cl.
CPC ..... *G09G 3/3225* (2013.01); *G09G 3/2025* (2013.01); *G09G 3/3233* (2013.01); *G09G 3/3258* (2013.01); *G09G 3/3275* (2013.01); *G09G 3/3266* (2013.01); *G09G 3/3291* (2013.01); *G09G 2300/04* (2013.01);
(Continued)

(58) Field of Classification Search
CPC ..... G09G 3/30–3/3291; G09G 2310/067; G09G 2310/06; G09G 2310/02–2310/0221
See application file for complete search history.

(56) References Cited

U.S. PATENT DOCUMENTS 7,825,878 B2 * 11/2010 Kawabe ..... G09G 3/2029 345/100
2005/0134536 A1 * 6/2005 Lo ..... G09G 3/3266 345/76

(Continued)

FOREIGN PATENT DOCUMENTS

CN 1811884 A 8/2006
CN 101325041 A 12/2008

(Continued)

*Primary Examiner* — David Tung
(74) *Attorney, Agent, or Firm* — Andrew C. Cheng

(57) ABSTRACT

The present invention provides an AMOLED panel driving circuit and driving method. The driving circuit includes: an AMOLED panel (2), a gate driver (4) and a source driver (6) each electrically connected to the AMOLED panel (2), and a timing controller (8) and a gamma IC (10) each electrically connected to the source driver (6). The timing controller (8) is further electrically connected to the gate driver (4) and the gamma IC (10). The timing controller (8) uses two sets of gate control signal to control the gate driver (4). The source driver (6) supplies a data signal to the AMOLED panel (2). The data signal includes a plurality of data frames and each of the data frames includes a plurality of sub-data-frames having equal time intervals.

13 Claims, 7 Drawing Sheets

(52) U.S. Cl.
CPC ..... *G09G 2310/0202* (2013.01); *G09G 2310/067* (2013.01); *G09G 2310/08* (2013.01); *G09G 2320/0276* (2013.01); *G09G 2320/043* (2013.01); *G09G 2370/08* (2013.01); *G09G 2370/14* (2013.01)

(56) References Cited

U.S. PATENT DOCUMENTS

2005/0231450 A1* 10/2005 Takai ..... G09G 3/2014 345/77
2006/0114199 A1* 6/2006 Kim ..... G09G 3/3233 345/77
2007/0080905 A1* 4/2007 Takahara ..... G09G 3/3233 345/76
2014/0184657 A1* 7/2014 Lee ..... G09G 5/10 345/690

FOREIGN PATENT DOCUMENTS

KR 20030065640 A 8/2003
KR 20090090117 A 8/2009

* cited by examiner

AMOLED (ACTIVE MATRIX ORGANIC LIGHT EMITTING DIODE) PANEL DRIVING CIRCUIT AND DRIVING METHOD

BACKGROUND OF THE INVENTION

1. Field of the Invention

The present invention relates to the field of flat panel displaying, and in particular to an AMOLED (Active Matrix Organic Light Emitting Diode) driving circuit and driving method.

2. The Related Arts

A flat display device has various advantages, such as thin device body, low power consumption, and being free of radiation, and is thus of wide applications. The flat display devices that are currently available include liquid crystal displays (LCDs) and organic electroluminescence devices (OELDs), which are also referred to as organic light emitting diodes (OLEDs).

The organic electroluminescence devices, which show the characteristics of self-illumination, high brightness, wide view angle, high contrast, flexibility, and low energy consumption, attract wide attention for serving as the next-generation display measures and gradually substitute the conventional liquid crystal displays for wide applications in various fields including mobile phone screens, computer monitors, and full-color television. The organic electroluminescence devices are different from the conventional liquid crystal displays in that they need no backlight and they use extremely thin coating layers of organic materials directly formed on the glass substrates so that when electrical currents flow therethrough, the organic material coating layers emit light.

The currently available organic light emitting diodes are classified according to the driving methods used and include a passive-matrix organic light emitting diode (PMOLED) and an active-matrix organic light emitting diodes (AMOLED). The process of manufacturing technology and material of the flat panel displays brings the AMOLED to the mainstream of future flat panel displays.

Referring to FIG. 1, which is a diagram showing a driving circuit of a conventional AMOLED panel, the driving circuit comprises two thin-film transistors 100, 200 and a storage capacitor 300. After being charged, the storage capacitor 300 applies a control voltage to a gate terminal of the second thin-film transistor 200 to set the second thin-film transistor 200 in a saturation zone in order to supply an electrical current to and light up the AMOLED panel. A driving circuit adopting such a structure, although simple in structure, may affect the threshold voltage $V_{th}$ of the second thin-film transistor 200 because the second thin-film transistor 200 has been long affected by electrons, and consequently, the electrical current of the AMOLED panel will be affected, leading to influence of uniformity of the AMOLED panel and thus deterioration of the displaying quality of the AMOLED panel.

SUMMARY OF THE INVENTION

An object of the present invention is to provide an AMOLED (Active Matrix Organic Light Emitting Diode) panel driving circuit, which divide a data frame of a data signal into eight constant-interval sub-frame signals and applies a pulse width modulation driving method to charge a storage capacitor so as to enhance the uniformity of the AMOLED panel and improve the displaying quality of the AMOLED panel.

Another object of the present invention is to provide AMOLED driving method, wherein the method adopts a pulse width modulation driving method to charge a storage capacitor of an internal pixel driving circuit so as to enhance the uniformity of the AMOLED panel and improve the displaying quality of the AMOLED panel.

To achieve the above objects, the present invention provides an AMOLED (Active Matrix Organic Light Emitting Diode) panel driving circuit, which comprises: an AMOLED panel, a gate driver electrically connected to the AMOLED panel, a source driver electrically connected to the AMOLED panel, a timing controller electrically connected to the source driver, and a gamma IC (Integrated Circuit) electrically connected to the source driver. The timing controller is further electrically connected to the gate driver and the gamma IC. The timing controller uses two sets of gate control signal to control the gate driver. The source driver supplies a data signal to the AMOLED panel. The data signal comprises a plurality of data frames. Each of the data frames comprises a plurality of sub-data-frames having equal time intervals.

The AMOLED panel comprises a plurality of internal pixel driving circuits. Each of the internal pixel driving circuits comprises a first thin-film transistor, a second thin-film transistor, a storage capacitor, a gate line, and a data line. The first thin-film transistor comprises a first gate terminal, a first drain terminal, and a first source terminal. The second thin-film transistor comprises a second gate terminal, a second drain terminal, and a second source terminal. The first gate terminal is electrically connected to the gate line. The first source terminal is electrically connected to the data line. The first drain terminal is electrically connected to the second gate terminal and an end of the storage capacitor. An opposite end of the storage capacitor and the second source terminal are connected to a driving power source. The second drain terminal is connected to an OLED (Organic Light Emitting Diode).

The gate driver supplies a scan signal to the AMOLED panel; and the gate driver comprises a gate control circuit and a gate driving circuit electrically connected to the gate control circuit, the gate control circuit being electrically connected to the timing controller, the gate driving circuit being electrically connected to the AMOLED panel, the gate driving circuit comprising a plurality of gate driving ICs; and the two sets of gate control signal are respectively a first set of gate control signal and a second set of gate control signal, the first set of gate control signal comprising a first start control signal, a first clock control signal, and a first enable control signal, the second set of gate control signal comprising a second start control signal, a second clock control signal, and a second enable control signal; and the first set of gate control signal controls the gate driver to cause charging of the AMOLED panel, the second set of gate control signal controlling the gate driver to cause discharging of the AMOLED panel.

The source driver comprises: a source control circuit and a source driving circuit electrically connected to the source control circuit, the source control circuit being electrically connected to the timing controller, the source driving circuit being electrically connected to the AMOLED panel, the source driving circuit comprising a plurality of source driving ICs; and the timing controller uses two source control signals to control the source driver, the two source control signals being respectively a low voltage differential signal and a source start control signal.

The AMOLED panel driving circuit further comprises a multiplexer electrically connected to the timing controller. The multiplexer comprises a high level input pin, a low level input pin, an enable control signal input pin, and a selective output pin. The P-gamma IC comprises a static high voltage pin. The static high voltage pin has a voltage that is constantly greater than or equal to voltages of output pins of the P-gamma IC. The enable control signal input pin is electrically connected to the timing controller. The selective output pin is electrically connected to the static high voltage pin of the P-gamma IC. The high level input pin receives a high level signal. The low level input pin receives a low level signal. The low level signal is 0V. When the timing controller supplies a source enable control signal to the multiplexer to allow the source enable control signal to control the multiplexer to supply a 0V voltage signal to the static high voltage pin of the P-gamma IC, the output pins of the P-gamma IC output voltages that are 0V. The output pins comprise first and fourteenth output pins.

Each of the data frames comprises eight sub-data-frames having equal time intervals; and the AMOLED panel driving circuit has a driving method that is a pulse width modulation based method.

The present invention also provides an AMOLED panel driving circuit, which comprises: an AMOLED panel, a gate driver electrically connected to the AMOLED panel, a source driver electrically connected to the AMOLED panel, a timing controller electrically connected to the source driver, and a gamma IC electrically connected to the source driver, the timing controller being further electrically connected to the gate driver and the gamma IC, the timing controller using two sets of gate control signal to control the gate driver, the source driver supplying a data signal to the AMOLED panel, the data signal comprising a plurality of data frames, each of the data frames comprising a plurality of sub-data-frames having equal time intervals;

wherein the AMOLED panel comprises a plurality of internal pixel driving circuits, each of the internal pixel driving circuits comprising a first thin-film transistor, a second thin-film transistor, a storage capacitor, a gate line, and a data line, the first thin-film transistor comprising a first gate terminal, a first drain terminal, and a first source terminal, the second thin-film transistor comprising a second gate terminal, a second drain terminal, and a second source terminal, the first gate terminal being electrically connected to the gate line, the first source terminal being electrically connected to the data line, the first drain terminal being electrically connected to the second gate terminal and an end of the storage capacitor, an opposite end of the storage capacitor and the second source terminal being adapted to connect to a driving power source, the second drain terminal being connected to an OLED.

The gate driver supplies a scan signal to the AMOLED panel; and the gate driver comprises a gate control circuit and a gate driving circuit electrically connected to the gate control circuit, the gate control circuit being electrically connected to the timing controller, the gate driving circuit being electrically connected to the AMOLED panel, the gate driving circuit comprising a plurality of gate driving ICs; and the two sets of gate control signal are respectively a first set of gate control signal and a second set of gate control signal, the first set of gate control signal comprising a first start control signal, a first clock control signal, and a first enable control signal, the second set of gate control signal comprising a second start control signal, a second clock control signal, and a second enable control signal; and the first set of gate control signal controls the gate driver to cause charging of the AMOLED panel, the second set of gate control signal controlling the gate driver to cause discharging of the AMOLED panel.

The source driver comprises: a source control circuit and a source driving circuit electrically connected to the source control circuit, the source control circuit being electrically connected to the timing controller, the source driving circuit being electrically connected to the AMOLED panel, the source driving circuit comprising a plurality of source driving ICs; and the timing controller uses two source control signals to control the source driver, the two source control signals being respectively a low voltage differential signal and a source start control signal.

The AMOLED panel driving circuit further comprises a multiplexer electrically connected to the timing controller. The multiplexer comprises a high level input pin, a low level input pin, an enable control signal input pin, and a selective output pin. The P-gamma IC comprises a static high voltage pin. The static high voltage pin has a voltage that is constantly greater than or equal to voltages of output pins of the P-gamma IC. The enable control signal input pin is electrically connected to the timing controller. The selective output pin is electrically connected to the static high voltage pin of the P-gamma IC. The high level input pin receives a high level signal. The low level input pin receives a low level signal. The low level signal is 0V. When the timing controller supplies a source enable control signal to the multiplexer to allow the source enable control signal to control the multiplexer to supply a 0V voltage signal to the static high voltage pin of the P-gamma IC, the output pins of the P-gamma IC output voltages that are 0V. The output pins comprise first and fourteenth output pins.

Each of the data frames comprises eight sub-data-frames having equal time intervals; and the AMOLED panel driving circuit has a driving method that is a pulse width modulation based method.

The present invention further provides an AMOLED panel driving method, which comprises the following steps:

(1) a timing controller of a driving circuit of an AMOLED panel supplying a first set of gate control signal to a gate driver of the driving circuit of the AMOLED panel so that the gate driver is controlled by the timing controller to supply a first scan signal to the AMOLED panel;

(2) the timing controller supplying a low voltage differential signal and a source start control signal to a source driver of the driving circuit of the AMOLED panel and supplying a source enable control signal to a P-gamma IC, the source enable control signal controlling the P-gamma IC to output a high level signal to the source driver, the source driver being controlled by the timing controller and P-gamma IC to supply a data signal to the AMOLED panel, the data signal comprising a plurality of data frames, each of the data frames comprising a plurality of sub-data-frames having equal time intervals;

(3) internal pixel driving circuits of the AMOLED panel electrically charging respective storage capacitors according to the first scan signal and the data signal so as to electrically charge pixels corresponding to the internal pixel driving circuits;

(4) the timing controller supplying a second set of gate control signal to the gate driver, the gate driver being controlled by the timing controller to supply a second scan signal to the AMOLED panel; and (5) the source enable control signal controlling the P-gamma IC to supply a low level signal to the source driver, and according to the second scan signal, the source driver being controlled by the timing controller and the P-gamma IC to control the storage capacitors of the internal pixel driving circuits to discharge so as to control the pixels corresponding to the internal pixel driving circuits to discharge.

The AMOLED panel driving circuit comprises: an AMOLED panel, a gate driver electrically connected to the AMOLED panel, a source driver electrically connected to the AMOLED panel, a timing controller electrically connected to the source driver, and a gamma IC (Integrated Circuit) electrically connected to the source driver, the timing controller being further electrically connected to the gate driver and the gamma IC;

the AMOLED panel comprises a plurality of internal pixel driving circuits, each of the internal pixel driving circuits comprising a first thin-film transistor, a second thin-film transistor, a storage capacitor, a gate line, and a data line, the first thin-film transistor comprising a first gate terminal, a first drain terminal, and a first source terminal, the second thin-film transistor comprising a second gate terminal, a second drain terminal, and a second source terminal, the first gate terminal being electrically connected to the gate line, the first source terminal being electrically connected to the data line, the first drain terminal being electrically connected to the second gate terminal and an end of the storage capacitor, an opposite end of the storage capacitor and the second source terminal being adapted to connect to a driving power source, the second drain terminal being connected to an OLED;

the gate driver comprises a gate control circuit and a gate driving circuit electrically connected to the gate control circuit, the gate control circuit being electrically connected to the timing controller, the gate driving circuit being electrically connected to the AMOLED panel, the gate driving circuit comprising a plurality of gate driving ICs;

the first set of gate control signal comprises a first start control signal, a first clock control signal, and a first enable control signal and the second set of gate control signal comprises a second start control signal, a second clock control signal, and a second enable control signal; and the source driver comprises: a source control circuit and a source driving circuit electrically connected to the source control circuit, the source control circuit being electrically connected to the timing controller, the source driving circuit being electrically connected to the AMOLED panel, the source driving circuit comprising a plurality of source driving ICs.

The AMOLED panel driving circuit further comprises a multiplexer electrically connected to the timing controller, the multiplexer comprising a high level input pin, a low level input pin, an enable control signal input pin, and a selective output pin, the P-gamma IC comprising a static high voltage pin, the static high voltage pin having a voltage that is constantly greater than or equal to voltages of output pins of the P-gamma IC, the enable control signal input pin being electrically connected to the timing controller, the selective output pin being electrically connected to the static high voltage pin of the P-gamma IC, the high level input pin being adapted to receive a high level signal, the low level input pin being adapted to receive a low level signal, the low level signal being 0V; the source enable control signal controls selection of the high level signal or the low level signal as an output signal of the selective output pin; and the static high voltage pin of the P-gamma IC supplies a voltage of which variation is in consistence with voltage outputs of the output pins thereof.

Each of the data frames comprises eight sub-data-frames having equal time intervals; and the AMOLED panel driving circuit has a driving method that is a pulse width modulation based method.

The efficacy of the present invention is that the present invention provides an AMOLED panel driving circuit and driving method, wherein on the basis of an existing 2T1C driving circuit, a timing control circuit and a P-gamma circuit are provided to control the gate driver and the source driver in order to achieve a function of direct discharging of the source driver for saving the cost of developing a new model of source driver that is capable of electrically discharging. Further, a pulse width modulation operation is adopted as a driving method of the AMOLED panel driving circuit and a complete data frame is divided into eight sub-data-frames having equal time intervals for achieving 255 grey levels without affecting the threshold voltage $V_{th}$ of the AMOLED panel and thus not altering the electrical current of the AMOLED panel so as to enhance the uniformity of the AMOLED panel and improve the displaying quality of the AMOLED panel.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Referring to FIGS. 2-5, the present invention provides an AMOLED (Active Matrix Organic Light Emitting Diode) panel driving circuit, which comprises: an AMOLED panel 2, a gate driver 4 electrically connected to the AMOLED panel 2, a source driver 6 electrically connected to the AMOLED panel 2, a timing controller 8 electrically connected to the source driver 6, and a gamma IC (Integrated Circuit) 10 electrically connected to the source driver 6. The timing controller 8 is further electrically connected to the gate driver 4 and gamma IC 10. The timing controller 8 uses two sets of gate control signal to control the gate driver 4. The source driver 6 supplies a data signal to the AMOLED panel 2. The data signal comprises a plurality of data frames and each of the data frames comprises a plurality of sub-data-frames having equal time intervals.

Figure 1:
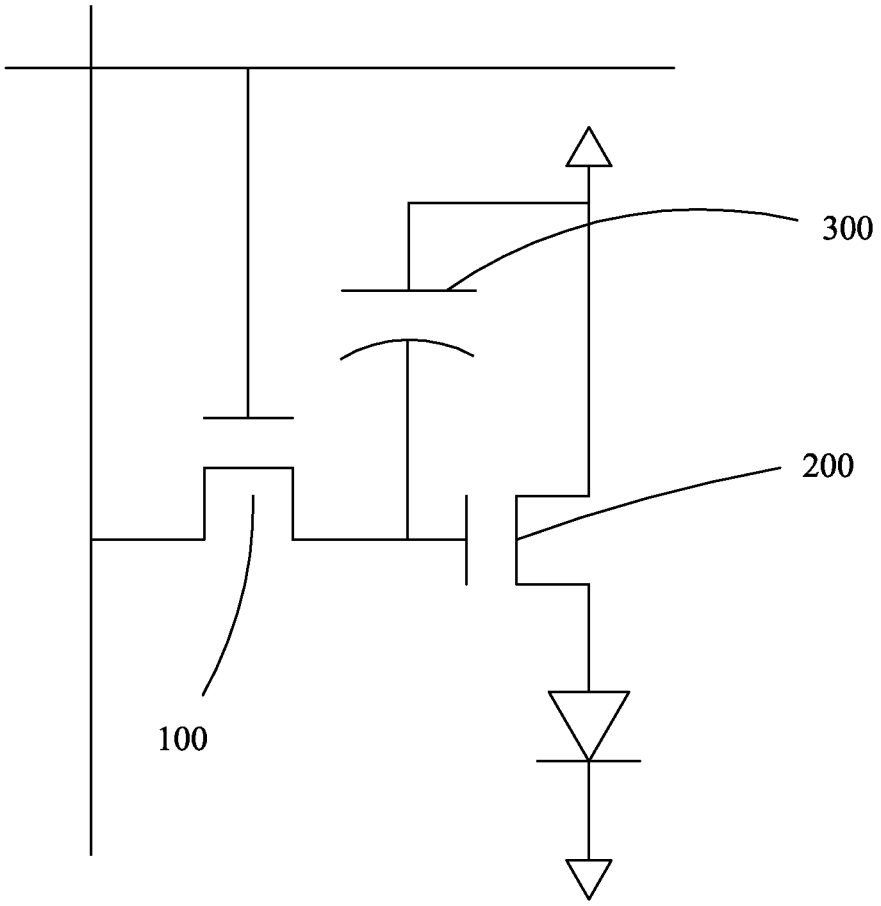
FIG. 1 is a schematic view showing a driving circuit of an OLED (Organic Light Emitting Diode) of a conventional AMOLED (Active Matrix Organic Light Emitting Diode) panel.
Figure 2:
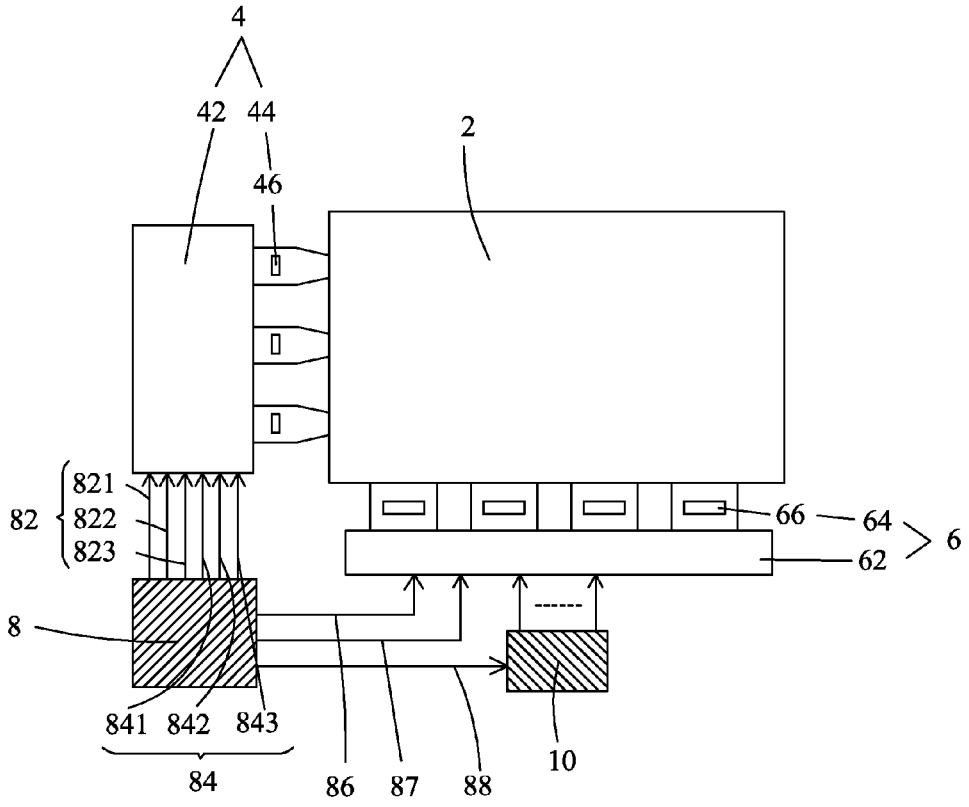
FIG. 2 is a schematic view showing a driving circuit of an AMOLED panel according to the present invention.
Figure 3:
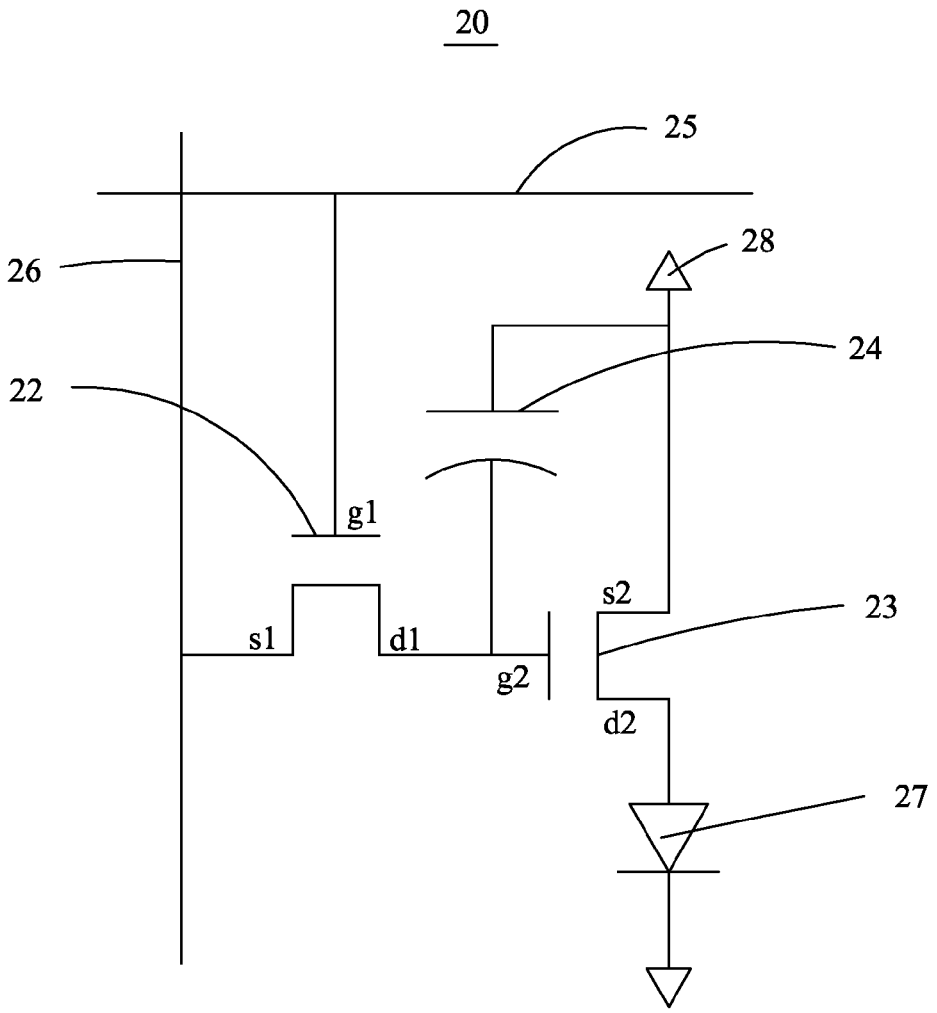
FIG. 3 is a schematic view showing a driving circuit of an internal pixel of an OLED of FIG. 2.

The AMOLED panel 2 comprises a plurality of internal pixel driving circuits 20, as shown in FIG. 3. The present invention is established on the basis of a conventional 2T1C driving and adopts pulse width modulation to drive the AMOLED panel 2, wherein each complete data frame is divided into a plurality of sub-data-frames having equal time intervals in order to achieve desired grey levels, which, together with proper circuit control, does not affect the threshold voltage $V_{th}$ of the driving thin-film transistor (the second thin-film transistor 23). Each of the internal pixel driving circuits 20 comprises a first thin-film transistor 22, a second thin-film transistor 23, a storage capacitor 24, a gate line 25, and a data line 26. The first thin-film transistor 22 is a switching thin-film transistor, which comprises a first gate terminal g1, a first drain terminal d1, and a first source terminal s1; and the second thin-film transistor 23 is a driving thin-film transistor, which comprises a second gate terminal g2, a second drain terminal d2, and a second source terminal s2. The first gate terminal g1 is electrically connected to the gate line 25. The first source terminal s1 is electrically connected to the data line 26. The first drain terminal d1 is electrically connected to the second gate terminal g2 and an end of the storage capacitor 24. An opposite end of the storage capacitor 24 and the second source terminal s2 are connectable to a driving power source. The second drain terminal d2 is connected to an OLED (Organic Light Emitting Diode) 27.

When the gate line 25 is selected, the first thin-film transistor 22 is activated and voltage from the data line 26 passes through the first thin-film transistor 22 to charge the storage capacitor 24, voltage of the storage capacitor 24 controlling a drain current of the second thin-film transistor 23; and when the gate line 25 is not selected, the first thin-film transistor 22 is cut off and electrical charge stored in the storage capacitor 24 continuously maintain the voltage of the second gate terminal g2 of the second thin-film transistor 23 to maintain the operation condition of the second thin-film transistor 23 in the time period of the frame.

The gate driver 4 is electrically connected to the gate line 25 of each of the internal pixel driving circuits 20 and the source driver 6 is electrically connected to the data line 26 of each of the internal pixel driving circuits 20. The gate driver 4 supplies a scan signal to the AMOLED panel 2. The gate driver 4 comprises a gate control circuit 42 and a gate driving circuit 44 electrically connected to the gate control circuit 42. The gate control circuit 42 is electrically connected to the timing controller 8. The gate driving circuit 44 is electrically connected to the AMOLED panel 2. The gate driving circuit 44 comprises a plurality of gate driving ICs 46. The gate driving ICs 46 are electrically connected to the gate lines 25 of the internal pixel driving circuits 20.

The two sets of gate control signal are respectively a first set of gate control signal 82 and a second set of gate control signal 84. The first set of gate control signal 82 comprises a first start control signal (STV) 821, a first clock control signal (CKV) 822, and a first enable control signal (OE) 823 and the second set of gate control signal 84 comprises a second start control signal (STV2) 841, a second clock control signal (CKV2) 842, and a second enable control signal (0E2) 843.

Figure 4:
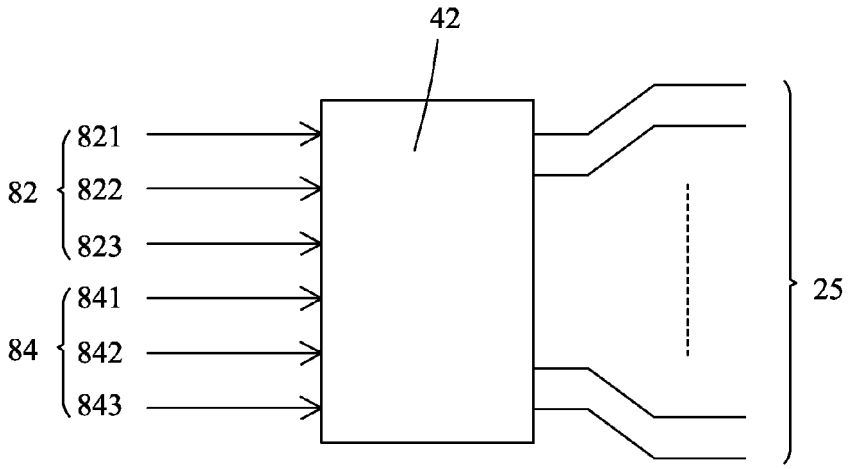
FIG. 4 is a schematic view showing circuit connection of a gate control circuit of FIG. 2.

As shown in FIG. 4, the first set of gate control signal 82 serves as input signals of the gate driver 4 for controlling the gate driver 4 to cause charging of the AMOLED panel 2. The second set of gate control signal 84 serves as input signals of the gate driver 4 for controlling the gate driver 4 to cause discharging of the AMOLED panel 2. The gate driver 4 has an output signal that is connected to the gate line 25 of each of the internal pixel driving circuits 20.

The source driver 6 comprises: a source control circuit 62 and a source driving circuit 64 electrically connected to the source control circuit 62. The source control circuit 62 is electrically connected to the timing controller 8. The source driving circuit 62 is electrically connected to the AMOLED panel 2. The source driving circuit 64 comprises a plurality of source driving ICs 66. The timing controller 8 uses two source control signals to control the source driver 6. The two source control signals are respectively a low voltage differential signal (Mini_LVDS) 86 and a source start control signal (STB) 87.

The AMOLED panel driving circuit further comprises a multiplexer (MUX) 12 electrically connected to the timing controller 8. The multiplexer 12 comprises a high level input pin 17, a low level input pin 18, an enable control signal input pin, and a selective output pin.

The gamma IC 10 comprises a static high voltage pin (STATIC_H) 16. Voltage of the static high voltage pin 16 is always higher than or equal to voltages of the output pins 15 of the gamma IC 10. The output pins 15 are first to fourteenth output pins.

The enable control signal input pin of the multiplexer 12 is electrically connected to the timing controller 8. The selective output pin is electrically connected to the static high voltage pin 16 of the gamma IC 10. The high level input pin 17 receives an input of a high level signal and the high level is a power supply voltage $V_{dd}$. The low level input pin 18 receives an input of a low level signal and the low level signal is 0V.

Figure 5:
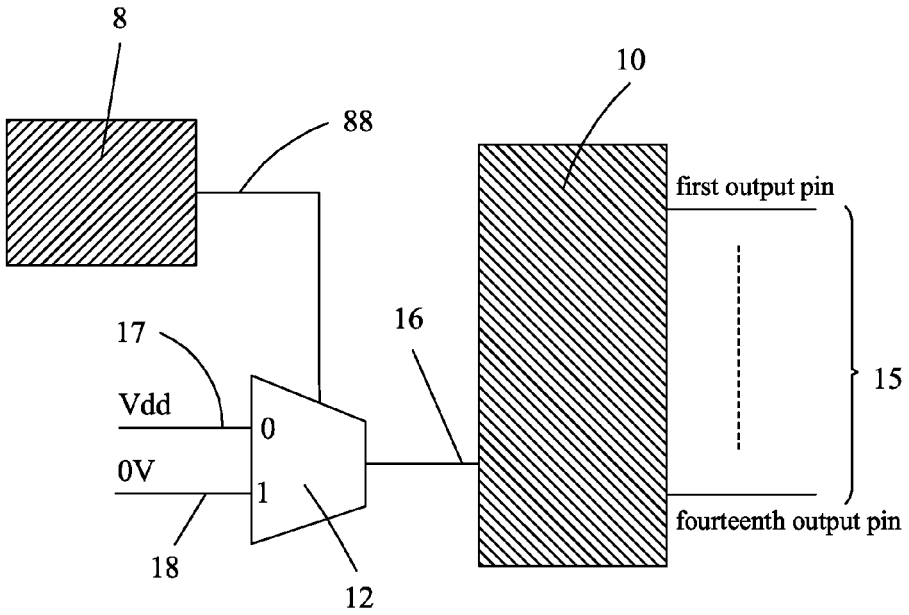
FIG. 5 is a schematic view showing circuit connection of a timing controller and a gamma IC of FIG. 2.

As shown in FIG. 5, when the timing controller 8 supplies a source enable control signal 88 to the multiplexer 12 to allow the source enable control signal 88 to control the multiplexer 12 to supply a 0V voltage signal to the static high voltage pin 16 of the gamma IC 10, the output pins 15 of the gamma IC 10 output voltages that are 0V, so that the source driver also outputs 0V and thus, voltage present on the data line 26 is also 0V. Thus, the source enable control signal 88 can be used to control the gamma IC 10 to directly achieve the function of discharging the source driver 6 and the cost of developing a new model of the source driver 6 that is capable of discharging electricity can be saved.

Figure 6:
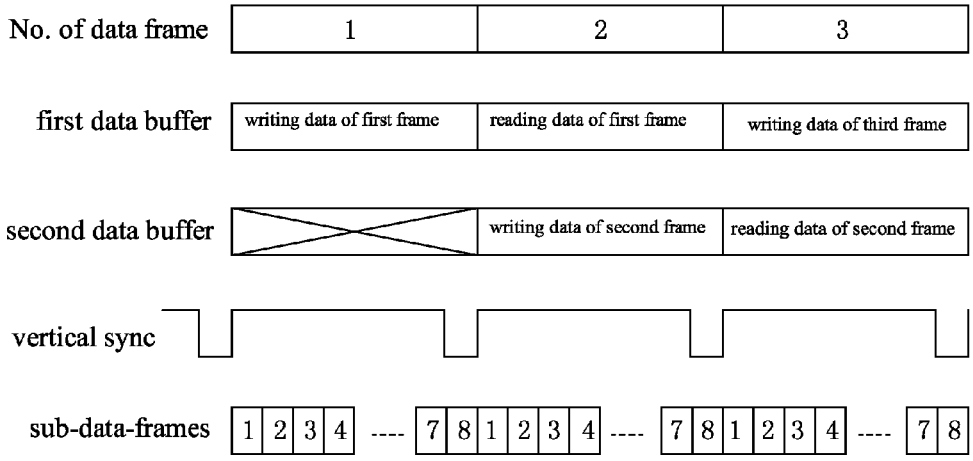
FIG. 6 is a control timing diagram of eight sub-data-frames of the AMOLED panel driving circuit according to the present invention.

Referring to FIG. 6, in the instant embodiment, each of the data frames comprises eight sub-data-frames having equal time intervals, allowing for providing 255 grey levels. On the basis of the 2T1C circuit, unique circuit control can be applied to achieve the pulse width modulation operation without causing influence of the threshold voltage $V_{th}$ of the driving thin-film transistor (the second thin-film transistor 23) in order to improve the uniformity of the AMOLED panel.

Figure 7:
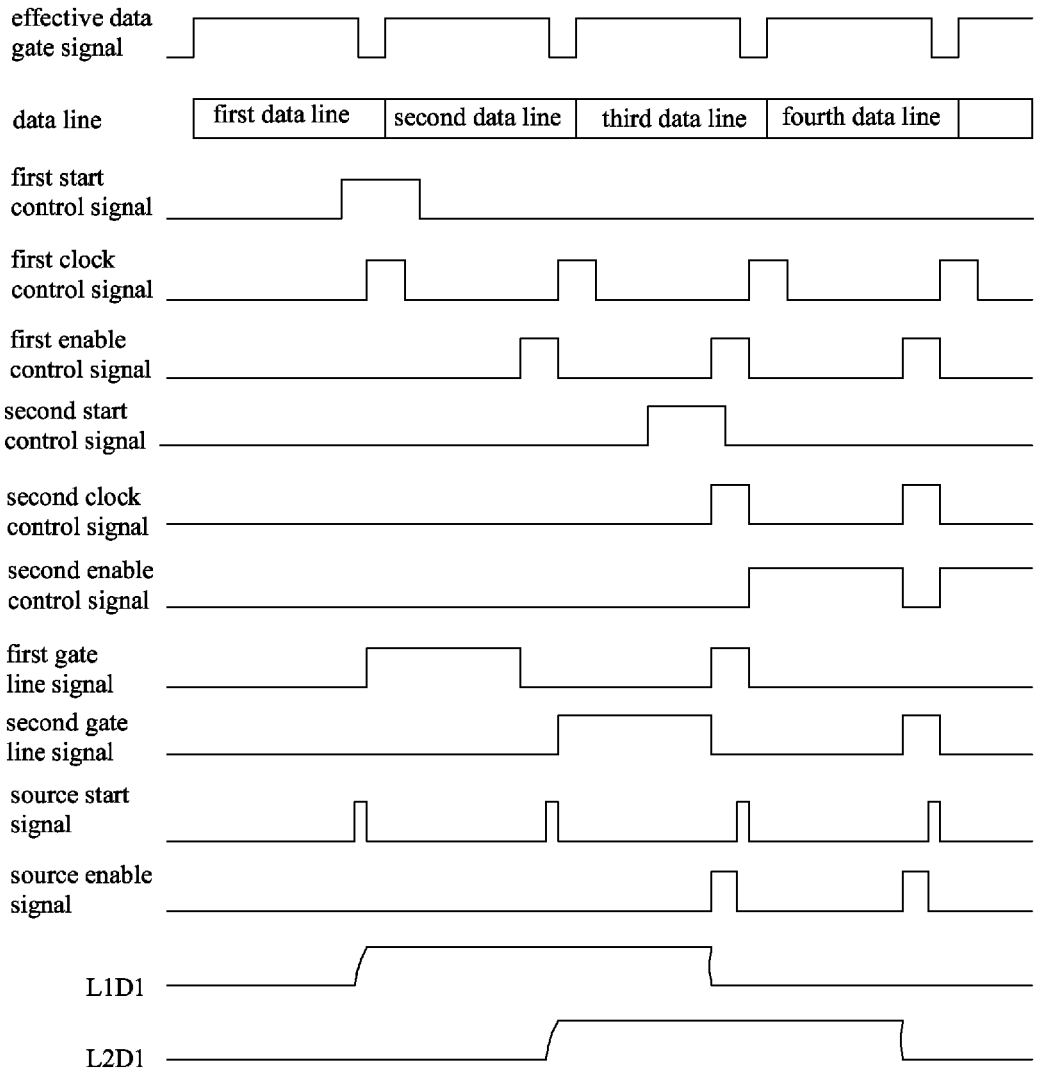
FIG. 7 is a control timing diagram of the driving method of the AMOLED panel driving circuit according to the present invention.
Figure 8:
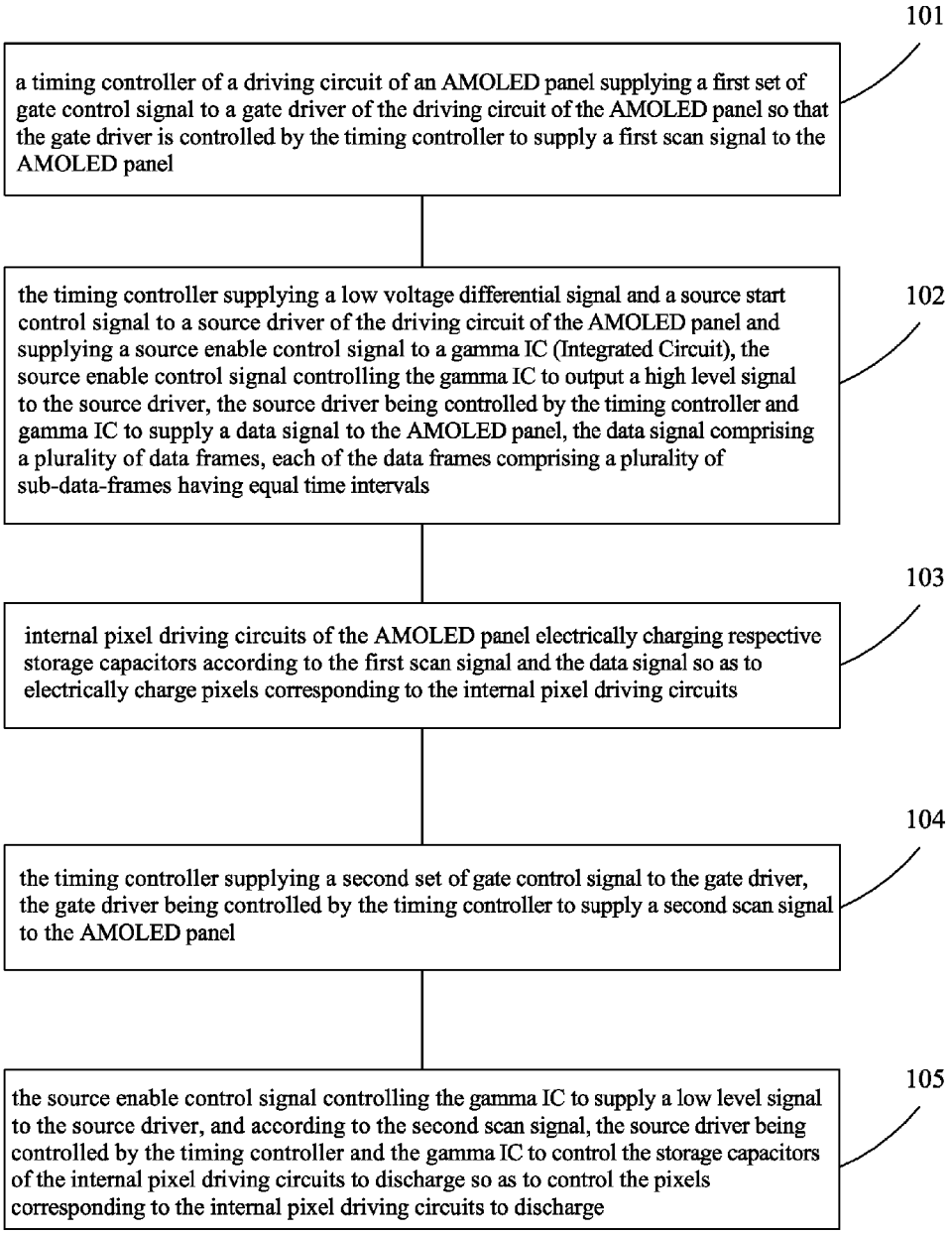
FIG. 8 is a flow chart illustrating a driving method of an AMOLED panel according to the present invention.

The AMOLED panel driving circuit adopts a driving method that is a pulse width modulation process, of which a timing diagram is shown in FIG. 7 and which is achieved with collaboration between the first set of gate control signal 82 and the second set of gate control signal 84 of the gate driver 4 and the source start control signal 87 of the source driver 6 and the source enable control signal 88 connected to the gamma IC 10, so as to realize an effect of generating grey levels with timing sequence of the constant sub-data-frames. In the drawings, the first set of gate control signal 82 is the conventional control signal and the source start control signal 87 is the conventional source control signal generally for driving the signal of the source driver 6 to the AMOLED panel 2 and also for using the second set of gate control signal 84 in combination with the source enable signal 88 to realize pulse width modulation.

In the instant embodiment, a pulse width modulation operation is adopted as a driving method of the AMOLED panel driving circuit, making it possible not to affect the threshold voltage $V_{th}$ of the second thin-film transistor 23 so as not to alter the current of the AMOLED panel 2 to thereby enhance the uniformity of the AMOLED panel 2 and improve the displaying quality of the AMOLED panel 2.

Referring to FIGS. 2-8, the present invention also provides an AMOLED panel driving method. The method comprises the following steps:

Step 101: a timing controller 8 of a driving circuit of an AMOLED panel 2 supplying a first set of gate control signal 82 to a gate driver 4 so that the gate driver 4 is controlled by the timing controller 8 to supply a first scan signal to the AMOLED panel 2. The AMOLED panel driving circuit comprises: an AMOLED panel 2, a gate driver 4 electrically connected to the AMOLED panel 2, a source driver 6 electrically connected to the AMOLED panel 2, a timing controller 8 electrically connected to the source driver 6, and a gamma IC (Integrated Circuit) 10 electrically connected to the source driver 6. The timing controller 8 is also electrically connected to the gate driver 4 and gamma IC 10.

The AMOLED panel 2 comprises a plurality of internal pixel driving circuits 20, as shown in FIG. 3. The present invention is established on the basis of a conventional 2T1C driving and adopts pulse width modulation to drive the AMOLED panel 2, wherein each complete data frame is divided into a plurality of sub-data-frames having equal time intervals in order to achieve desired grey levels, which, together with proper circuit control, does not affect the threshold voltage $V_{th}$ of the driving thin-film transistor (the second thin-film transistor 23). Each of the internal pixel driving circuits 20 comprises a first thin-film transistor 22, a second thin-film transistor 23, a storage capacitor 24, a gate line 25, and a data line 26. The first thin-film transistor 22 is a switching thin-film transistor, which comprises a first gate terminal g1, a first drain terminal d1, and a first source terminal s1; and the second thin-film transistor 23 is a driving thin-film transistor, which comprises a second gate terminal g2, a second drain terminal d2, and a second source terminal s2. The first gate terminal g1 is electrically connected to the gate line 25. The first source terminal s1 is electrically connected to the data line 26. The first drain terminal d1 is electrically connected to the second gate terminal g2 and an end of the storage capacitor 24. Another end of the storage capacitor 24 and the second source terminal s2 are connectable to a driving power source. The second drain terminal d2 is connected to an OLED (Organic Light Emitting Diode) 27.

When the gate line 25 is selected, the first thin-film transistor 22 is activated and voltage from the data line 26 passes through the first thin-film transistor 22 to charge the storage capacitor 24, voltage of the storage capacitor 24 controlling a drain current of the second thin-film transistor 23; and when the gate line 25 is not selected, the first thin-film transistor 22 is cut off and electrical charge stored in the storage capacitor 24 continuously maintain the voltage of the second gate terminal g2 of the second thin-film transistor 23 to maintain the operation condition of the second thin-film transistor 23 in the time period of the frame.

The gate driver 4 is electrically connected to the gate line 25 of each of the internal pixel driving circuits 20 and the source driver 6 is electrically connected to the data line 26 of each of the internal pixel driving circuits 20. The gate driver 4 comprises a gate control circuit 42 and a gate driving circuit 44 electrically connected to the gate control circuit 42. The gate control circuit 42 is electrically connected to the timing controller 8. The gate driving circuit 44 is electrically connected to the AMOLED panel 2. The gate driving circuit 44 comprises a plurality of gate driving ICs 46. The gate driving ICs 46 are electrically connected to the gate lines 25 of the internal pixel driving circuits 20.

As shown in FIG. 4, the first set of gate control signal 82 comprises a first start control signal 821, a first clock control signal 822, and a first enable control signal 823. The gate driver 4 has an output signal that is connected to the gate line 25 of each of the internal pixel driving circuits.

Step 102: the timing controller 8 supplying a low voltage differential signal 86 and a source start control signal 87 to the source driver 6 of the driving circuit of the AMOLED panel 2 and supplying a source enable control signal 88 to a gamma IC 10, the source enable control signal 88 controlling the gamma IC 10 to output a high level signal to the source driver 6, the source driver 6 being controlled by the timing controller 8 and gamma IC 10 to supply a data signal to the AMOLED panel 2, the data signal comprising a plurality of data frames, each of the data frames comprising a plurality of sub-data-frames having equal time intervals. In the instant embodiment, each of the data frames comprises eight sub-data-frames having equal time intervals.

The source driver 6 comprises: a source control circuit 62 and a source driving circuit 64 electrically connected to the source control circuit 62. The source control circuit 62 is electrically connected to the timing controller 8. The source driving circuit 62 is electrically connected to the AMOLED panel 2. The source driving circuit 64 comprises a plurality of source driving ICs 66.

The AMOLED panel driving circuit further comprises a multiplexer (MUX) 12 electrically connected to the timing controller 8. The multiplexer 12 comprises a high level input pin 17, a low level input pin 18, an enable control signal input pin, and a selective output pin.

The gamma IC 10 comprises a static high voltage pin (STATIC_H) 16. Voltage of the static high voltage pin 16 is always higher than or equal to voltages of the output pins 15 of the gamma IC 10. The output pins 15 are first to fourteenth output pins.

The enable control signal input pin of the multiplexer 12 is electrically connected to the timing controller 8. The selective output pin is electrically connected to the static high voltage pin 16 of the gamma IC 10. The high level input pin 17 receives an input of a high level signal and the high level is a power supply voltage $V_{dd}$. The low level input pin 18 receives an input of a low level signal and the low level signal is 0V. The source enable control signal 88 controls selection of the high level signal or the low level signal as an output signal of the selective output pin. The static high voltage pin 16 of gamma IC 10 supplies a voltage of which variation is in consistence with voltage outputs of the output pins 15.

As shown in FIG. 5, when the timing controller 8 supplies a source enable control signal 88 to the multiplexer 12 to allow the source enable control signal 88 to control the multiplexer 12 to supply a 0V voltage signal to the static high voltage pin 16 of the gamma IC 10, the output pins 15 of the gamma IC 10 output voltages that are 0V, so that the source driver also outputs 0V and thus, voltage present on the data line 26 is also 0V. Thus, the source enable control signal 88 can be used to control the gamma IC 10 to directly achieve the function of discharging the source driver 6 and the cost of developing a new model of the source driver 6 that is capable of discharging electricity can be saved.

Step 103: the internal pixel driving circuits 20 of the AMOLED panel 2 electrically charging respective storage capacitors 24 according to the first scan signal and the data signal so as to electrically charge pixels corresponding to the internal pixel driving circuits 20.

Steps 101-103 are the process of charging pixels.

Step 104: the timing controller 8 supplying a second set of gate control signal 84 to the gate driver 4, the gate driver 4 being controlled by the timing controller 8 to supply a second scan signal to the AMOLED panel 2.

The second set of gate control signal 84 comprises a second start control signal 841, a second clock control signal 842, and a second enable control signal 843.

Step 105: the source enable control signal 88 controlling the gamma IC 10 to supply a low level signal to the source driver 6, and according to the second scan signal, the source driver 6 being controlled by the timing controller 8 and the gamma IC 10 to control the storage capacitors 24 of the internal pixel driving circuits 20 to discharge so as to control the pixels corresponding to the internal pixel driving circuits 20 to discharge.

Steps 104-105 are the process of discharging the pixels. The time interval of charging/discharging can be controlled by the timing controller 8 in order to achieve pulse width modulation.

Referring to FIG. 6, in the instant embodiment, each of the data frames comprises eight sub-data-frames having equal time intervals, allowing for providing 255 grey levels. On the basis of the 2T1C circuit, unique circuit control can be applied to achieve the pulse width modulation operation without causing influence of the threshold voltage $V_{th}$ of the driving thin-film transistor (the second thin-film transistor 23) in order to improve the uniformity of the AMOLED panel 2.

The AMOLED panel driving circuit adopts a driving method that is a pulse width modulation process, of which a timing diagram is shown in FIG. 7 and which is achieved with collaboration between the first set of gate control signal 82 and the second set of gate control signal 84 of the gate driver 4 and the source start control signal 87 of the source driver 6 and the source enable control signal 88 connected to the gamma IC 10, so as to realize an effect of generating grey levels with timing sequence of the constant sub-data-frames. In the drawings, the first set of gate control signal 82 is the conventional control signal and the source start control signal 87 is the conventional source control signal generally for driving the signal of the source driver 6 to the AMOLED panel 2 and also for using the second set of gate control signal 84 in combination with the source enable signal 88 to realize pulse width modulation.

In summary, the present invention provides an AMOLED panel driving circuit and driving method, wherein on the basis of an existing 2T1C driving circuit, a timing control circuit and a gamma circuit are provided to control the gate driver and the source driver in order to achieve a function of direct discharging of the source driver for saving the cost of developing a new model of source driver that is capable of electrically discharging. Further, a pulse width modulation operation is adopted as a driving method of the AMOLED panel driving circuit and a complete data frame is divided into eight sub-data-frames having equal time intervals for achieving 255 grey levels without affecting the threshold voltage $V_{th}$ of the AMOLED panel and thus not altering the electrical current of the AMOLED panel so as to enhance the uniformity of the AMOLED panel and improve the displaying quality of the AMOLED panel.

Based on the description given above, those having ordinary skills of the art may easily contemplate various changes and modifications of the technical solution and technical ideas of the present invention and all these changes and modifications are considered within the protection scope of right for the present invention.

What is claimed is:

1. An AMOLED (Active Matrix Organic Light Emitting Diode) panel driving circuit, comprising: an AMOLED panel, a gate driver electrically connected to the AMOLED panel, a source driver electrically connected to the AMOLED panel, a timing controller electrically connected to the source driver, and a gamma IC (Integrated Circuit) electrically connected to the source driver, the timing controller being further electrically connected to the gate driver and the gamma IC, the timing controller using two sets of gate control signal to control the gate driver, the source driver supplying a data signal to the AMOLED panel, the data signal comprising a plurality of data frames, each of the data frames comprising a plurality of sub-data-frames having equal time intervals;

and further comprising a multiplexer electrically connected to the timing controller, the multiplexer comprising a high level input pin, a low level input pin, an enable control signal input pin, and a selective output pin, the gamma IC comprising a static high voltage pin, the static high voltage pin having a voltage that is constantly greater than or equal to voltages of output pins of the gamma IC, the enable control signal input pin being electrically connected to the timing controller, the selective output pin being electrically connected to the static high voltage pin of the gamma IC, the high level input pin being adapted to receive a high level signal, the low level input pin being adapted to receive a low level signal, the low level signal being 0V, whereby when the timing controller supplies a source enable control signal to the multiplexer to allow the source enable control signal to control the multiplexer to supply a 0V voltage signal to the static high voltage pin of the gamma IC, the output pins of the gamma IC output voltages that are 0V, the output pins comprising first and fourteenth output pins.

2. The AMOLED panel driving circuit as claimed in claim 1, wherein the AMOLED panel comprises a plurality of internal pixel driving circuits, each of the internal pixel driving circuits comprising a first thin-film transistor, a second thin-film transistor, a storage capacitor, a gate line, and a data line, the first thin-film transistor comprising a first gate terminal, a first drain terminal, and a first source terminal, the second thin-film transistor comprising a second gate terminal, a second drain terminal, and a second source terminal, the first gate terminal being electrically connected to the gate line, the first source terminal being electrically connected to the data line, the first drain terminal being electrically connected to the second gate terminal and an end of the storage capacitor, an opposite end of the storage capacitor and the second source terminal being adapted to connect to a driving power source, the second drain terminal being connected to an OLED (Organic Light Emitting Diode).

3. The AMOLED panel driving circuit as claimed in claim 1, wherein the gate driver supplies a scan signal to the AMOLED panel; and the gate driver comprises a gate control circuit and a gate driving circuit electrically connected to the gate control circuit, the gate control circuit being electrically connected to the timing controller, the gate driving circuit being electrically connected to the AMOLED panel, the gate driving circuit comprising a plurality of gate driving ICs; and the two sets of gate control signal are respectively a first set of gate control signal and a second set of gate control signal, the first set of gate control signal comprising a first start control signal, a first clock control signal, and a first enable control signal, the second set of gate control signal comprising a second start control signal, a second clock control signal, and a second enable control signal; and the first set of gate control signal controls the gate driver to cause charging of the AMOLED panel, the second set of gate control signal controlling the gate driver to cause discharging of the AMOLED panel.

4. The AMOLED panel driving circuit as claimed in claim 1, wherein the source driver comprises: a source control circuit and a source driving circuit electrically connected to the source control circuit, the source control circuit being electrically connected to the timing controller, the source driving circuit being electrically connected to the AMOLED panel, the source driving circuit comprising a plurality of source driving ICs; and the timing controller uses two source control signals to control the source driver, the two source control signals being respectively a low voltage differential signal and a source start control signal.

5. The AMOLED panel driving circuit as claimed in claim 1, wherein each of the data frames comprises eight sub-data-frames having equal time intervals; and the AMOLED panel driving circuit has a driving method that is a pulse width modulation based method.

6. An AMOLED (Active Matrix Organic Light Emitting Diode) panel driving circuit, comprising: an AMOLED panel, a gate driver electrically connected to the AMOLED panel, a source driver electrically connected to the AMOLED panel, a timing controller electrically connected to the source driver, and a gamma IC (Integrated Circuit) electrically connected to the source driver, the timing controller being further electrically connected to the gate driver and the gamma IC, the timing controller using two sets of gate control signal to control the gate driver, the source driver supplying a data signal to the AMOLED panel, the data signal comprising a plurality of data frames, each of the data frames comprising a plurality of sub-data-frames having equal time intervals; and further comprising a multiplexer electrically connected to the timing controller, the multiplexer comprising a high level input pin, a low level input pin, an enable control signal input pin, and a selective output pin, the gamma IC comprising a static high voltage pin, the static high voltage pin having a voltage that is constantly greater than or equal to voltages of output pins of the gamma IC, the enable control signal input pin being electrically connected to the timing controller, the selective output pin being electrically connected to the static high voltage pin of the gamma IC, the high level input pin being adapted to receive a high level signal, the low level input pin being adapted to receive a low level signal, the low level signal being 0V, whereby when the timing controller supplies a source enable control signal to the multiplexer to allow the source enable control signal to control the multiplexer to supply a 0V voltage signal to the static high voltage pin of the gamma IC, the output pins of the gamma IC output voltages that are 0V, the output pins comprising first and fourteenth output pins;

wherein the AMOLED panel comprises a plurality of internal pixel driving circuits, each of the internal pixel driving circuits comprising a first thin-film transistor, a second thin-film transistor, a storage capacitor, a gate line, and a data line, the first thin-film transistor comprising a first gate terminal, a first drain terminal, and a first source terminal, the second thin-film transistor comprising a second gate terminal, a second drain terminal, and a second source terminal, the first gate terminal being electrically connected to the gate line, the first source terminal being electrically connected to the data line, the first drain terminal being electrically connected to the second gate terminal and an end of the storage capacitor, an opposite end of the storage capacitor and the second source terminal being adapted to connect to a driving power source, the second drain terminal being connected to an OLED (Organic Light Emitting Diode).

7. The AMOLED panel driving circuit as claimed in claim 6, wherein the gate driver supplies a scan signal to the AMOLED panel; and the gate driver comprises a gate control circuit and a gate driving circuit electrically connected to the gate control circuit, the gate control circuit being electrically connected to the timing controller, the gate driving circuit being electrically connected to the AMOLED panel, the gate driving circuit comprising a plurality of gate driving ICs; and the two sets of gate control signal are respectively a first set of gate control signal and a second set of gate control signal, the first set of gate control signal comprising a first start control signal, a first clock control signal, and a first enable control signal, the second set of gate control signal comprising a second start control signal, a second clock control signal, and a second enable control signal; and the first set of gate control signal controls the gate driver to cause charging of the AMOLED panel, the second set of gate control signal controlling the gate driver to cause discharging of the AMOLED panel.

8. The AMOLED panel driving circuit as claimed in claim 6, wherein the source driver comprises: a source control circuit and a source driving circuit electrically connected to the source control circuit, the source control circuit being electrically connected to the timing controller, the source driving circuit being electrically connected to the AMOLED panel, the source driving circuit comprising a plurality of source driving ICs; and the timing controller uses two source control signals to control the source driver, the two source control signals being respectively a low voltage differential signal and a source start control signal.

9. The AMOLED panel driving circuit as claimed in claim 6, wherein each of the data frames comprises eight sub-data-frames having equal time intervals; and the AMOLED panel driving circuit has a driving method that is a pulse width modulation based method.

10. An AMOLED (Active Matrix Organic Light Emitting Diode) panel driving method, comprising the following steps:

(1) a timing controller of a driving circuit of an AMOLED panel supplying a first set of gate control signal to a gate driver of the driving circuit of the AMOLED panel so that the gate driver is controlled by the timing controller to supply a first scan signal to the AMOLED panel;

(2) the timing controller supplying a low voltage differential signal and a source start control signal to a source driver of the driving circuit of the AMOLED panel and supplying a source enable control signal to a gamma IC (Integrated Circuit), the source enable control signal controlling the gamma IC to output a high level signal to the source driver, the source driver being controlled by the timing controller and gamma IC to supply a data signal to the AMOLED panel, the data signal comprising a plurality of data frames, each of the data frames comprising a plurality of sub-data-frames having equal time intervals;

(3) internal pixel driving circuits of the AMOLED panel electrically charging respective storage capacitors according to the first scan signal and the data signal so as to electrically charge pixels corresponding to the internal pixel driving circuits;

(4) the timing controller supplying a second set of gate control signal to the gate driver, the gate driver being controlled by the timing controller to supply a second scan signal to the AMOLED panel; and (5) the source enable control signal controlling the gamma IC to supply a low level signal to the source driver, and according to the second scan signal, the source driver being controlled by the timing controller and the gamma IC to control the storage capacitors of the internal pixel driving circuits to discharge so as to control the pixels corresponding to the internal pixel driving circuits to discharge.

11. The AMOLED panel driving method as claimed in claim 10, wherein the AMOLED panel driving circuit comprises: an AMOLED panel, a gate driver electrically connected to the AMOLED panel, a source driver electrically connected to the AMOLED panel, a timing controller electrically connected to the source driver, and a gamma IC (Integrated Circuit) electrically connected to the source driver, the timing controller being further electrically connected to the gate driver and the gamma IC;

the AMOLED panel comprises a plurality of internal pixel driving circuits, each of the internal pixel driving circuits comprising a first thin-film transistor, a second thin-film transistor, a storage capacitor, a gate line, and a data line, the first thin-film transistor comprising a first gate terminal, a first drain terminal, and a first source terminal, the second thin-film transistor comprising a second gate terminal, a second drain terminal, and a second source terminal, the first gate terminal being electrically connected to the gate line, the first source terminal being electrically connected to the data line, the first drain terminal being electrically connected to the second gate terminal and an end of the storage capacitor, an opposite end of the storage capacitor and the second source terminal being adapted to connect to a driving power source, the second drain terminal being connected to an OLED (Organic Light Emitting Diode);

the gate driver comprises a gate control circuit and a gate driving circuit electrically connected to the gate control circuit, the gate control circuit being electrically connected to the timing controller, the gate driving circuit being electrically connected to the AMOLED panel, the gate driving circuit comprising a plurality of gate driving ICs;

the first set of gate control signal comprises a first start control signal, a first clock control signal, and a first enable control signal and the second set of gate control signal comprises a second start control signal, a second clock control signal, and a second enable control signal; and the source driver comprises: a source control circuit and a source driving circuit electrically connected to the source control circuit, the source control circuit being electrically connected to the timing controller, the source driving circuit being electrically connected to the AMOLED panel, the source driving circuit comprising a plurality of source driving ICs.

12. The AMOLED panel driving method as claimed in claim 10, wherein the AMOLED panel driving circuit further comprises a multiplexer electrically connected to the timing controller, the multiplexer comprising a high level input pin, a low level input pin, an enable control signal input pin, and a selective output pin, the gamma IC comprising a static high voltage pin, the static high voltage pin having a voltage that is constantly greater than or equal to voltages of output pins of the gamma IC, the enable control signal input pin being electrically connected to the timing controller, the selective output pin being electrically connected to the static high voltage pin of the gamma IC, the high level input pin being adapted to receive a high level signal, the low level input pin being adapted to receive a low level signal, the low level signal being 0V; the source enable control signal controls selection of the high level signal or the low level signal as an output signal of the selective output pin; and the static high voltage pin of the gamma IC supplies a voltage of which variation is in consistence with voltage outputs of the output pins thereof.

13. The AMOLED panel driving method as claimed in claim 10, wherein each of the data frames comprises eight sub-data-frames having equal time intervals; and the AMOLED panel driving circuit has a driving method that is a pulse width modulation based method.

* * * * *